US005078631A

United States Patent [19]

Harbert

[11] Patent Number: 5,078,631

[45] Date of Patent: Jan. 7, 1992

[54] MARINE EXHAUST SYSTEM

[75] Inventor: Earl W. Harbert, Coral Springs, Fla.

[73] Assignee: Vernay Laboratories, Inc., Yellow Springs, Ohio

[21] Appl. No.: 653,192

[22] Filed: Feb. 8, 1991

Related U.S. Application Data

[63] Continuation-in-part of Ser. No. 481,073, Feb. 16, 1990, Pat. No. 5,022,877.

[51] Int. Cl.[5] ..... B63H 21/32

[52] U.S. Cl. ..... 440/89; 60/324; 181/215

[58] Field of Search ..... 440/88, 89; 60/39.2, 60/290, 309, 310, 324; 181/212, 213, 215, 220, 221, 235, 249, 259, 260; 123/323

[56] References Cited

U.S. PATENT DOCUMENTS 1,816,371 7/1931 Hefti ..... 440/89

2,204,294 6/1940 Blanchard ..... 181/260

*Primary Examiner*—Jesûs D. Sotelo

*Attorney, Agent, or Firm*—Biebel & French

[57] ABSTRACT

A marine exhaust system is provided for separating the gas from the water of gas/water mixture produced by a marine engine, and expelling the gas a sufficient distance from the hull of a boat to place it outside of the turbulent boundary layer surrounding the hull and the low pressure area following behind the boat. A nozzle having a variable outlet area is mounted amidship on the hull for maintaining a predetermined pressure within the exhaust system in order to expel the gases a maximum distance from the boat. In addition, apparatus is provided for removing the water from the exhaust system prior to the gases reaching an acoustical chamber for attenuating exhaust gas noises.

17 Claims, 15 Drawing Sheets

VENT VALVE
CHARGE VALVE
IGNITION
NEUTRAL SAFETY SWITCH

MARINE EXHAUST SYSTEM

CROSS-REFERENCE TO RELATED APPLICATIONS

This application is a continuation-in-part of application Ser. No. 481,073, filed Feb. 16, 1990 now U.S. Pat. No. 5,022,877.

BACKGROUND OF THE INVENTION

The present invention generally relates to exhaust systems and more particularly to a marine exhaust system which expels exhaust gas to a point outside of the turbuent boundary layer surrounding the moving hull of a boat.

Engine powered boats, such as sport fishing type boats and cruise boats, suffer from a problem resulting from the low pressure area created behind the boat and the associated turbulent boundary layer extending along the sides of the boat. Exhaust gases which are typically expelled either to the rear of the boat or from the side are trapped within the low pressure area behind the boat and may recirculate up to the passenger compartment or cabin of the boat.

Attempts to solve the above problem include the exhaust system described in U.S. Pat. No. 4,019,456 to Harbert. In this system a gas/water mixture is fed to a muffler which first uses the water to attenuate the exhaust noise and then separates the water from the exhaust gas. The water is then expelled from the boat through an exit in the rear of the hull and the gas is passed through a chamber which accelerates it before it is expelled from the boat through an outlet nozzle located in the hullside near the transom. This design suffers from the problem that the nozzle has a fixed outlet area and thus must be designed to be most efficient at the average cruising speed of the engine. When the engine is operated at full throttle speeds, the exhaust back pressure is excessive for the engine. In addition, when the boat is operated at trolling speeds or low engine speeds, the exhaust gases are not expelled far enough from the boat hull to project them outside the effect of the low pressure area behind the boat or the turbulent boundary layer surrounding the hull.

Although one embodiment of the Harbert patent contemplates providing a spring valve 148 which opens to permit passage of additional gas and prevent excessive build up of back pressure in the system, this solution suffers from the problem of the valve being noisy as it flaps open and closed due to the rapid pulsations of the columns of exhaust gases that is typical of reciprocating engines. In addition, the spring valve does not provide controlled expulsion of gases to maximize the velocity of the gases as they leave the nozzle in order to project them outside of the turbulent boundary layer.

Furthermore, since the Harbert muffler design depends on water to attenuate the exhaust noises, the effectiveness of the muffler will vary depending upon the quantity of water within the muffler at any given time. The quantity of water changes with engine speed and thus its effectiveness at attenuating the exhaust noises is limited.

Accordingly, there is a need for a marine exhaust system which will effectively project exhaust gases through or outside of the turbulent boundary layer surrounding a boat hull for any given engine or boat speed.

In addition, there is a need for an exhaust assembly which will effectively separate exhaust gases from water and efficiently attenuate exhaust noises for all operating conditions.

SUMMARY OF THE INVENTION

The present invention provides a marine exhaust system having a nozzle for projecting exhaust gases a maximum distance from a boat hull for any given engine speed, and means for separating the water and gas components in a gas/water mixture prior to conveying the gas through a sound attenuation chamber for reducing the exhaust noises.

In a preferred embodiment, a mixture of exhaust gas and cooling water is conveyed from a marine engine through an exhaust pipe to an enlarged pipe to slow the flow of the gas/water mixture, such that the heavier water will separate from the gas and settle to a lower portion of the enlarged pipe to provide an initial separation of water from the exhaust gases.

The gas/water mixture is then conveyed to a first chamber for separating the water from the gases and the water is drained out through a water discharge pipe leading through the hull of the boat. The exhaust gases are conveyed from the first chamber to a second chamber having sound baffling means for attenuating the exhaust noises, and then to a nozzle having a variable outlet area located in the side of the boat hull.

Water which condenses out of the gas within the second chamber is discharged into the water discharge pipe and is conveyed with the water from the first chamber to a water outlet in the bottom of the hull of the boat. The water outlet is covered by a reverse scoop having an opening facing away from the direction of the water flow when the boat is moving in a forward direction, such that a suction effect is created to assist gravity and internal system pressure in expelling the water from the discharge pipe. Also in the preferred embodiment, the first chamber is provided with a vertical tube having an opening near a top portion of the first chamber providing an exit for gases after they have been separated from the water in the gas/water mixture. The gases entering the vertical tube are then conveyed to a centrally located, perforated tube within the second chamber which works in conjunction with at least one other perforated tube for attenuating the exhaust noise as the gas passes through the tubes.

The nozzle is provided with a flexible orifice means for varying the outlet area of the nozzle, and control means located on top and bottom portions of the flexible orifice means control the opening of the nozzle. The control means are acted upon by actuator means located remotely from the nozzle.

The actuator means may be in the form of a mechanical linkage to the throttle control system for the boat's engine, or in the form of an electromechanical drive means connected to sensors for sensing the engine speed and the exhaust system pressure. In either case, the actuator means acts on the control means to provide a large nozzle outlet area at high engine speeds and to smoothly and continuously close down the nozzle area as the engine speed is decreased.

Thus, the exhaust system pressure may be increased at low engine speeds to project the exhaust gases further from the boat hull, and the nozzle outlet area may be increased as the engine speed increases to prevent excessive pressure build-up within the exhaust system. In this manner the exhaust system pressure may be maintained at or below the maximum pressure recommended by the engine manufacturer and thus, the distance to which the gases may be expelled from the boat hull is maximized.

In an alternative embodiment of the invention the portion of the exhaust system for separating water from exhaust gases and attenuating exhaust noises is housed in a single muffler or exhaust assembly structure. The exhaust assembly structure includes first and second portions defined between top and bottom walls of the structure, wherein the second portion is located above the first portion.

An intermediate wall separates the first and second portions such that the first portion forms a water separation chamber and the second portion forms an exhaust noise attenuation portion. The first portion includes an inlet for receiving a gas/water mixture and a water exit for discharging water from the exhaust assembly. A first portion wall is located between the inlet and the intermediate wall and includes means defining apertures whereby exhaust gases may pass from the inlet to the intermediate wall for passage into the second portion. In addition, a water baffle is located within the first portion between the first portion wall and the bottom wall.

The second portion of the exhaust assembly is divided into upper, lower and intermediate chambers by upper and lower second portion walls. A conduit is provided between the intermediate wall and the lower second portion wall for conveying exhaust gases to the intermediate chamber of the second portion. The upper wall of the second portion is provided with apertures through which exhaust gases may pass into the upper chamber, and a pair of conduits are provided for conveying the exhaust gases from the upper chamber to the lower chamber. Finally, an exhaust gas exit is provided at the lower chamber through which the exhaust gases may pass out of the exhaust assembly.

In an alternative embodiment of the nozzle assembly, the nozzle may be formed having an inlet and outlet and a flow passage defined between the inlet and outlet, wherein the nozzle inlet is connected to the outlet of the exhaust assembly. Control means in the form of either a pivoting or sliding gate is provided for varying the cross sectional area of the flow passage whereby the velocity of exhaust gases exiting the nozzle may be controlled. As in the previous embodiment of the nozzle assembly, actuator means are provided for actuating the control means to locate the control means at a desired position for defining a desired cross sectional area within the flow passage.

In a third embodiment of the exhaust assembly, the portions for separating water from exhaust gases and for attenuating exhaust gas noises are housed in a single muffler or exhaust assembly structure. The exhaust assembly is provided with a horizontal configuration in which the water separation portion is located in side-by-side relationship with a noise attenuation portion.

Other objects and advantages of the invention will be apparent from the following description, the accompanying drawings, and the appended claims.

DETAILED DESCRIPTION OF THE PREFERRED EMBODIMENT

Figures 1, 2A:
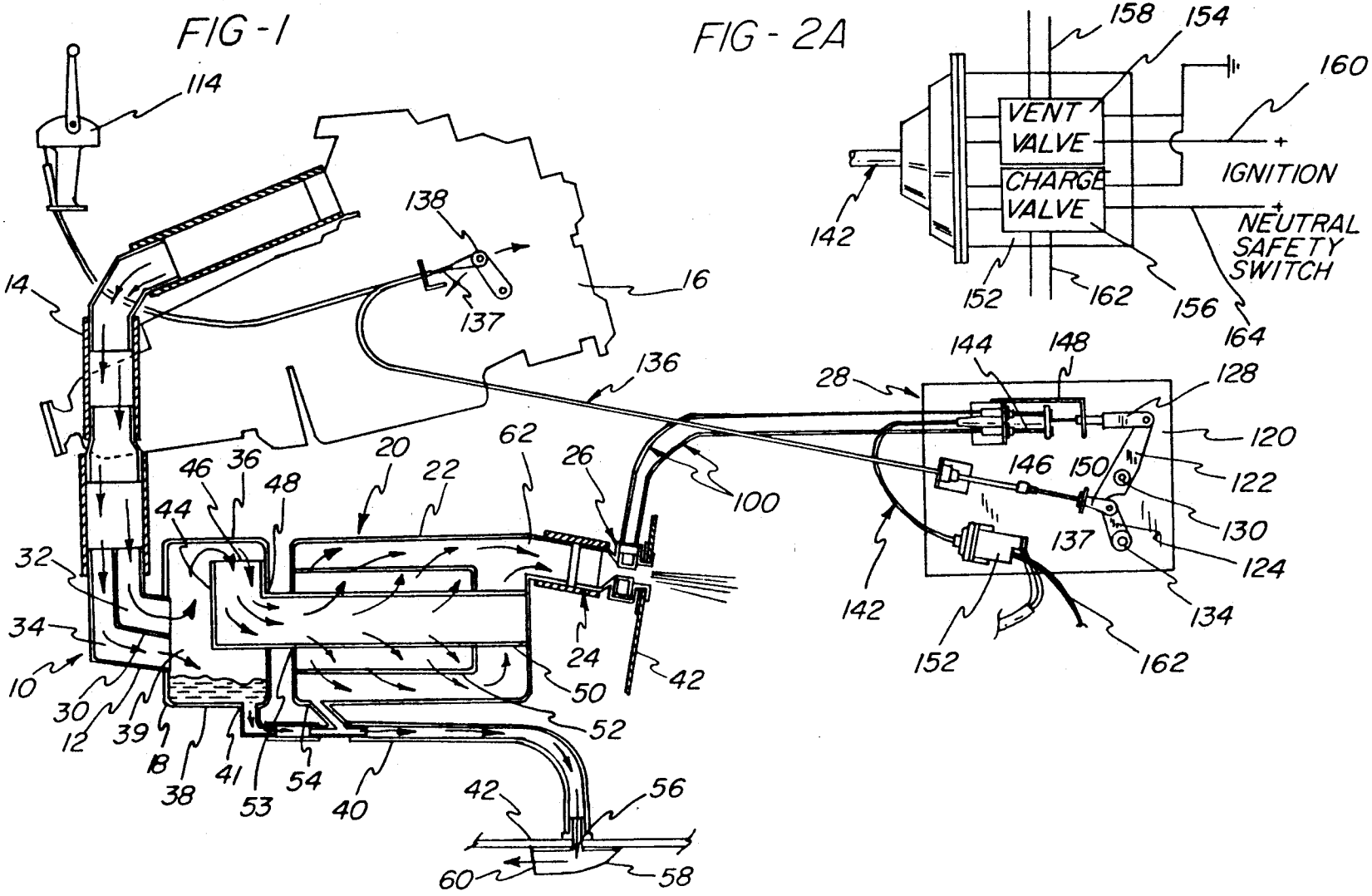
FIG. 1 is a schematic of the present exhaust system showing a mechanical linkage actuator.
FIG. 2A is a schematic view of the connecting means actuator for the mechanical linkage actuator shown in FIGS. 1 and 2.

Referring to FIG. 1, it can be seen that the exhaust system 10 of the present invention includes an expansion pipe 12 connected to the exhaust pipe 14 of a marine engine 16 for receiving a gas/water mixture from the engine 16. The expansion pipe 12 provides an initial separation of the water from the gas and conveys them to a first chamber 18 of an exhaust assembly 20 which further separates the water from the gas and conveys the water away from the boat. The gas passes from the first chamber to a second chamber 22 of the exhaust assembly 20 which has baffling means for attenuating the exhaust noise. The exhaust gases then pass from the second chamber 22 to a nozzle 24 which has a variable outlet area which is controlled by control means 26 connected to actuator means 28 which are remotely located from the nozzle 24.

The expansion pipe 12 is formed of a larger diameter than the exhaust pipe 14 coming from the engine 16 such that the expansion pipe 12 slows the velocity of the gas/water mixture and allows the heavier liquid to settle to the bottom of the pipe 12 and thereby provides an initial stage of water separation.

The expansion pipe 12 is oriented substantially horizontally with a slight downward slope from the engine exhaust pipe 14 to the first chamber 18. The expansion pipe 12 includes a baffle 30 which is also oriented substantially horizontally and which divides the expansion pipe 12 into approximately equal upper and lower portions 32,34. The baffle 30 serves to provide an initial separation of a gas/water mixture coming from the engine 16 such that water flows through the lower portion 34 of the expansion pipe 12 and gases pass through the upper portion 32.

The exhaust gases and water are conveyed from the expansion pipe 12 to a first chamber 18 designed to provide for maximum water removal from the exhaust gases. The first chamber 18 is provided with a top wall 36 and a bottom wall 38 and an entrance 39 between the top and bottom walls 36, 38 for receiving the gas and water from the expansion pipe 12.

Water collects along the bottom of the first chamber 18 and is conveyed away from the chamber 18 by means of a water discharge pipe 40 connected to an exit 41 in the bottom wall 38 of the chamber 18. The discharge pipe 40 is further connected to the bottom of the hull 42 of the boat for discharging the water away from the boat.

The first chamber 18 further includes a vertical tube 44 having an upper end 46 adjacent the top wall 36 and a lower end connected to a gas exit 48 in a wall of the first chamber 18 between the top and bottom walls 36,38. The upper end 46 of the tube 44 receives gases which have been separated from the water coming from the engine exhaust pipe 14 and expansion pipe 12 and provides an effectively complete separation of the gas from the water which collects in the bottom of the chamber 18.

The gases exiting the first chamber 18 are conveyed to a second chamber 22 which acts as a acoustical chamber to attenuate the exhaust gas noises. The second chamber 22 is formed as an elongated chamber within which are located a plurality of perforated sound baffling tubes 50,52, one of the tubes 50 being substantially centrally located within the second chamber. The tube 50 is connected to a substantially centrally located entrance 53 to the second chamber 22 for receiving gases from the first chamber 18 and extends the full length of the second chamber 22. The exhaust gases pass through at least one other perforated tube 52 to further attenuate the exhaust gas noises, and the tube 52 may be positioned such that it concentrically surrounds the centrally located tube 50. In addition, a water exit 54 is provided for removing water which condenses out of the gases within the second chamber 22 and is located at a lower portion of the second chamber 22, exteriorly of the sound baffling tubes 50,52.

The water exit 54 of the second chamber 22 is connected to the water discharge pipe 40 running from the first chamber 18 for conveying water to an outlet 56 in the bottom of the boat's hull 42. The outlet 56 in the hull bottom 56 is covered by a reverse scoop 58 having an opening 60 facing away from the direction of water flow as it would move over a boat's hull 42 when the boat is moving in a forward direction. Thus, the water flow over the scoop 58 will create a suction action on the water within the discharge pipe 40 and thus improve water removal from the first and second chambers 18,22.

As a result of not using water within the second chamber 22 to reduce the exhaust noises, the amount of sound reduction is maintained at a consistent level without the variations which result from relying on water which is present in a wet exhaust attenuation system in varying amounts depending upon operating conditions within the system. Furthermore, by designing the second chamber 22 to only handle gases, which have more predictable flow characteristics than a gas/water mixture, the baffling means within the second chamber 22 can be designed for the most efficient fluid flow through the chamber 22.

After the gases within the second chamber 22 have passed through the perforated tubes 50,52, they are conveyed through an outlet 62 located in an upper portion of the second chamber 22 to a nozzle 24. The nozzle 24 is located adjacent to and above the loaded water line and amidship on the boat hull 42, and is directed at a slight downward angle toward the water.

Figure 4:
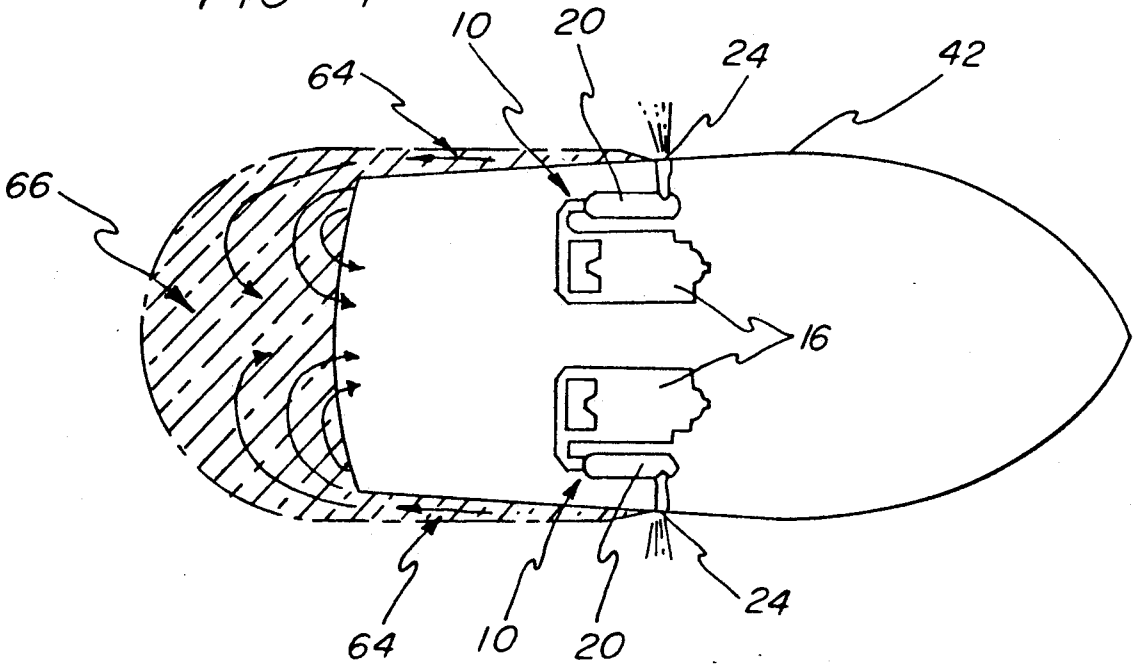
FIG. 4 is a top view showing the relative placement of the exhaust system and engine to a boat hull.

As can be seen in FIG. 4, the exhaust assembly 20 containing the first and second chambers 18,22 preferably extends within the engine compartment alongside and outboard of the engine 16 to facilitate locating the nozzle 24 amidship on the hull 42. Placing the exhaust system 10 entirely within the engine compartment also results in more usable storage space being available in the area behind the engine compartment of the boat, since the exhaust system 10 is no longer routed through this area. In addition, by placing the exhaust system 10 within the engine compartment, the exhaust noise is further abated by the soundproofing already present in the compartment for reducing the engine noise. It should be noted that the vertical position of the exhaust system 10 within the boat is preferably such that the bottom of the exhaust system 10 is above the loaded water line to ensure proper drainage of water from the system 10.

By locating the nozzle 24 amidship on the hull 42, the exhaust gases are expelled at approximately the widest part of the boat, which is forward of the thicker turbulent boundary layer of air 64 along the hull side. Thus, the gases are discharged at a point ahead of the troublesome low pressure areas 66 which follow the boat.

Figure 5:
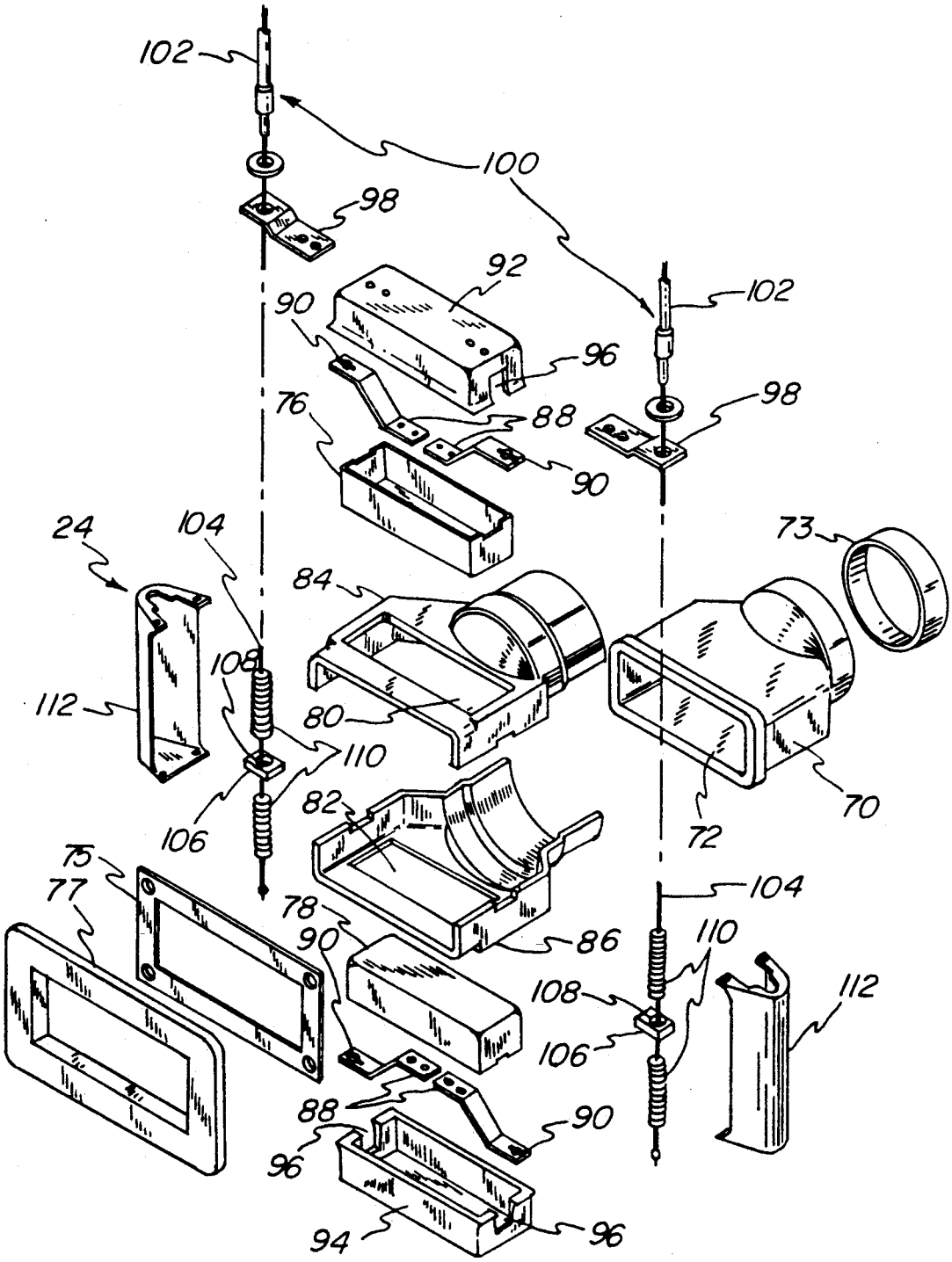
FIG. 5 is an exploded view of the nozzle of the present invention.
Figure 6:
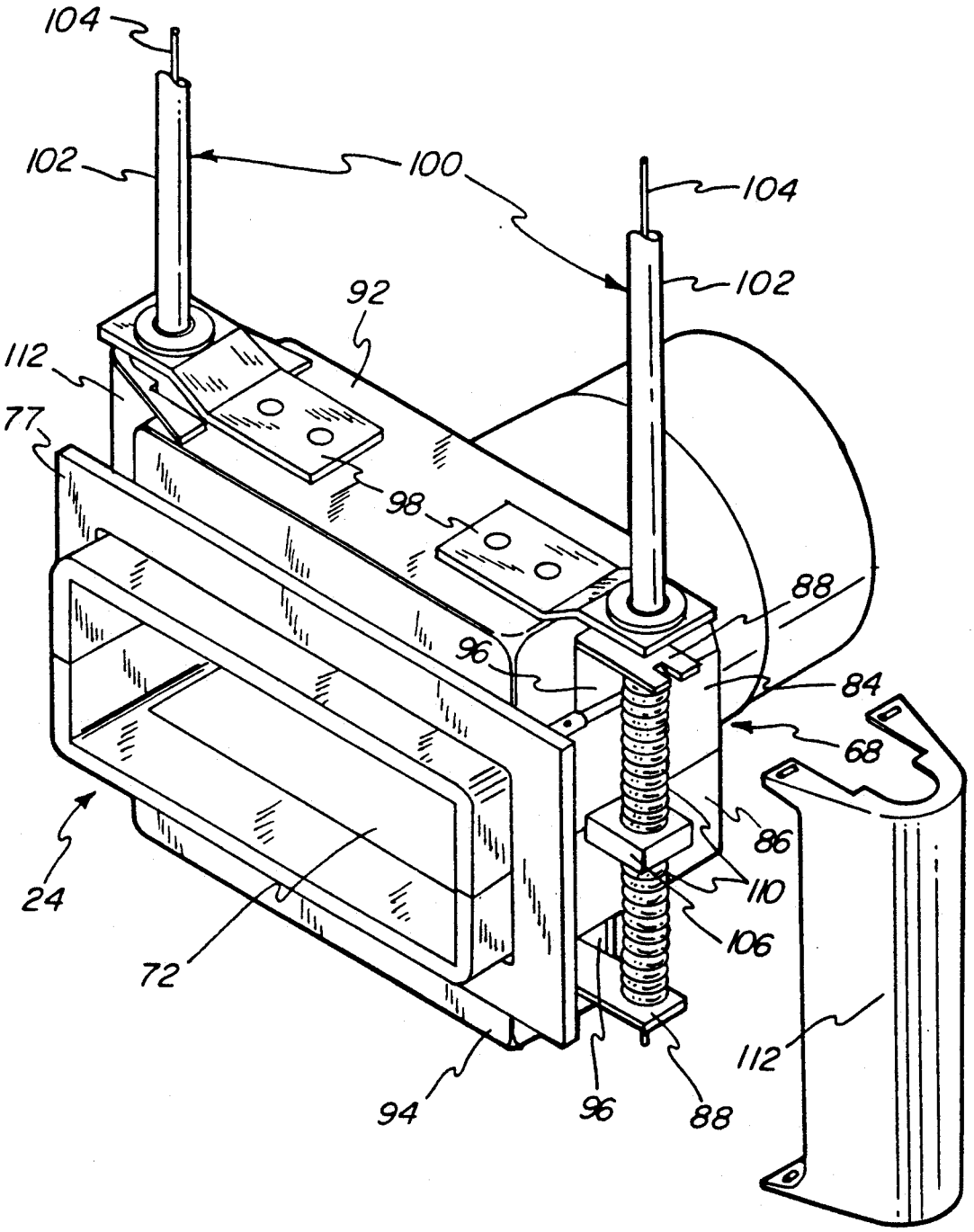
FIG. 6 is a perspective view of the nozzle with one of the spring covers removed.

Referring to FIGS. 5 and 6, the nozzle 24 is constructed such that the outlet area can be continuously varied between a plurality of positions depending upon the engine speed and the amount of back pressure within the system 10. The nozzle 24 includes a nozzle body 68 within which is located a flexible orifice means 70 which may be formed of a suitable flexible elastic material such as neoprene and which defines an opening 72 forming the nozzle outlet area. A retaining ring 73 is provided for holding the orifice means 70 in place within the nozzle body 68. In addition, a fastening plate 75 and face plate 77 are provided for attaching the nozzle body 68 to the hull 42 of the boat.

Control means 26 act on the outer surface of the flexible orifice means 70 to vary the outlet area of the nozzle 24. The orifice means 70 may be formed as a flexible sleeve which can be stretched slightly as the control means 26 act upon it to decrease the outlet area of the nozzle 24. The orifice means 70 may alternatively be constructed with accordion shaped folds along upper and lower portions of the orifice means 70 such that the orifice means 70 need not be stretched as the nozzle outlet area is decreased.

The control means 26 include upper and lower generally rectangularly shaped pistons 76,78 which pass through apertures 80,82 formed in top and bottom portions 84, 86 of the nozzle body 68 to contact the orifice means 70. Cable anchors 88, having means defining a hole 90 therethrough, extend from either side of each of the pistons 76,78 and a piston cover 92,94 is juxtaposed over each of the pistons 76,78 and attached to the nozzle body 68. A slot 96 for receiving the cable anchors 88 is formed in opposing sides of each of the piston covers 92,94 to allow vertical movement of the pistons 76,78 and cable anchors 88, and cable guides 98 are mounted to either side of an upper one of the piston covers 92,94.

The control means 26 further includes a pair of control cable assemblies 100, each including a cable cover 102 and a control cable 104 within the cable cover 102. The cable covers 102 are attached to the cable anchors 88, at the holes 90 therein, on either side of one of the pistons 76, and an end of each of the control cables 104 is attached to the cable anchors 88, at the holes 90 therein, on the other of the pistons 78. Thus, the control cable assemblies 100 act to draw the pistons 76,78 toward one another to nearly close off the opening 72 formed by the flexible orifice means 70 and reduce the outlet area of the nozzle 24.

A pair of spring seats 106 is attached to the nozzle body 68 intermediate the top and bottom sides 84,86, with each seat 106 having means defining a hole 108 therethrough. The control cables 104 on the sides of the nozzle body 68 pass through the holes 108 in the spring seats 106. A pair of springs 110 is positioned over each of the control cables 104 with one of each of the springs 110 located between a spring seat 106 and a cable anchor 88 such that the springs 110 act to bias the pistons 76,78 apart when the control cables 104 are not actuated to move the pistons 76,78 toward one another. In addition, if it is necessary to disconnect the nozzle 24 from the system of controls 26 for any reason, the cables 104 can be quickly disconnected and the springs 110 will force the nozzle 24 to assume a fully open position. A pair of spring covers 112 are provided in either side of the nozzle 24 for covering the springs 110 and the cable anchors 88 along each side of the nozzle body 68.

Figure 3:
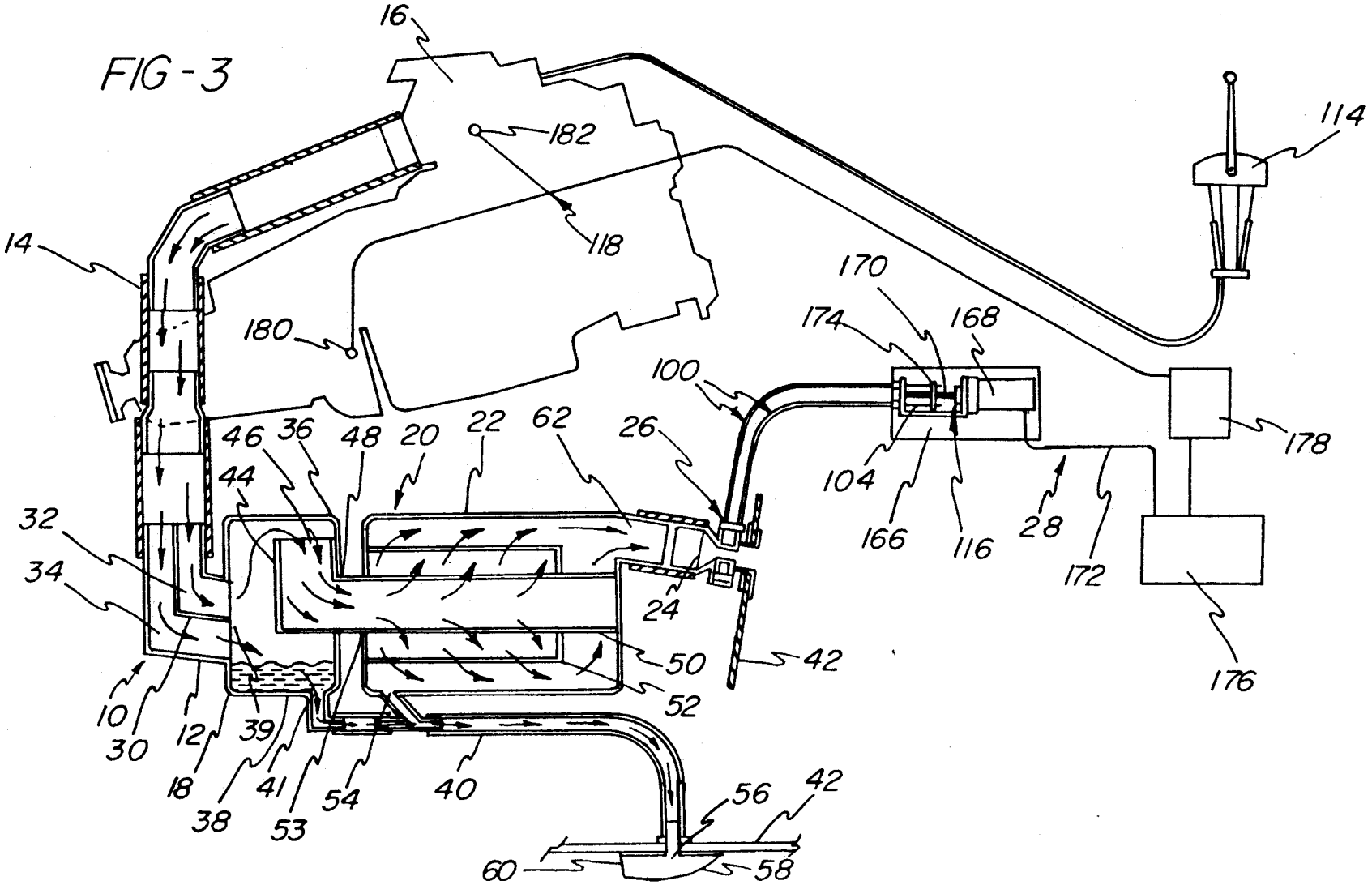
FIG. 3 is a schematic of the present exhaust system showing an electromechanical actuator.

Referring to FIGS. 1 and 3, actuator means 28 are provided remote from the nozzle 24 to actuate the control cable 104 and selectively position the control means 26 with reference to a desired exhaust system pressure. The actuator and control means 28,26 act to reduce the nozzle outlet area during low engine speeds and thus increase the exhaust system pressure such that the distance that the gases are expelled from the nozzle 24 is increased in order to penetrate the turbulent boundary layer of air 64 surrounding the hull 42 of the boat when the boat is in motion. The actuator and control means 28,26 also act to increase the nozzle outlet area at higher engine speeds and thus prevent excessive pressure from building up within the exhaust system 10.

The actuator means 28 may either be in the form of a mechanical linkage which is connected to a throttle control 114 for the engine to the control means 26, as illustrated in FIG. 1, or in the form of an electromechanical drive and sensing means where an electromechanical drive 116 moves the control means 26 in response to input signals generated by sensing means 118, as illustrated in FIG. 3. The sensing means 118 of the electromechanical drive system being positioned to sense the speed of the engine 16 and the pressure in the exhaust system 10.

Figure 2:
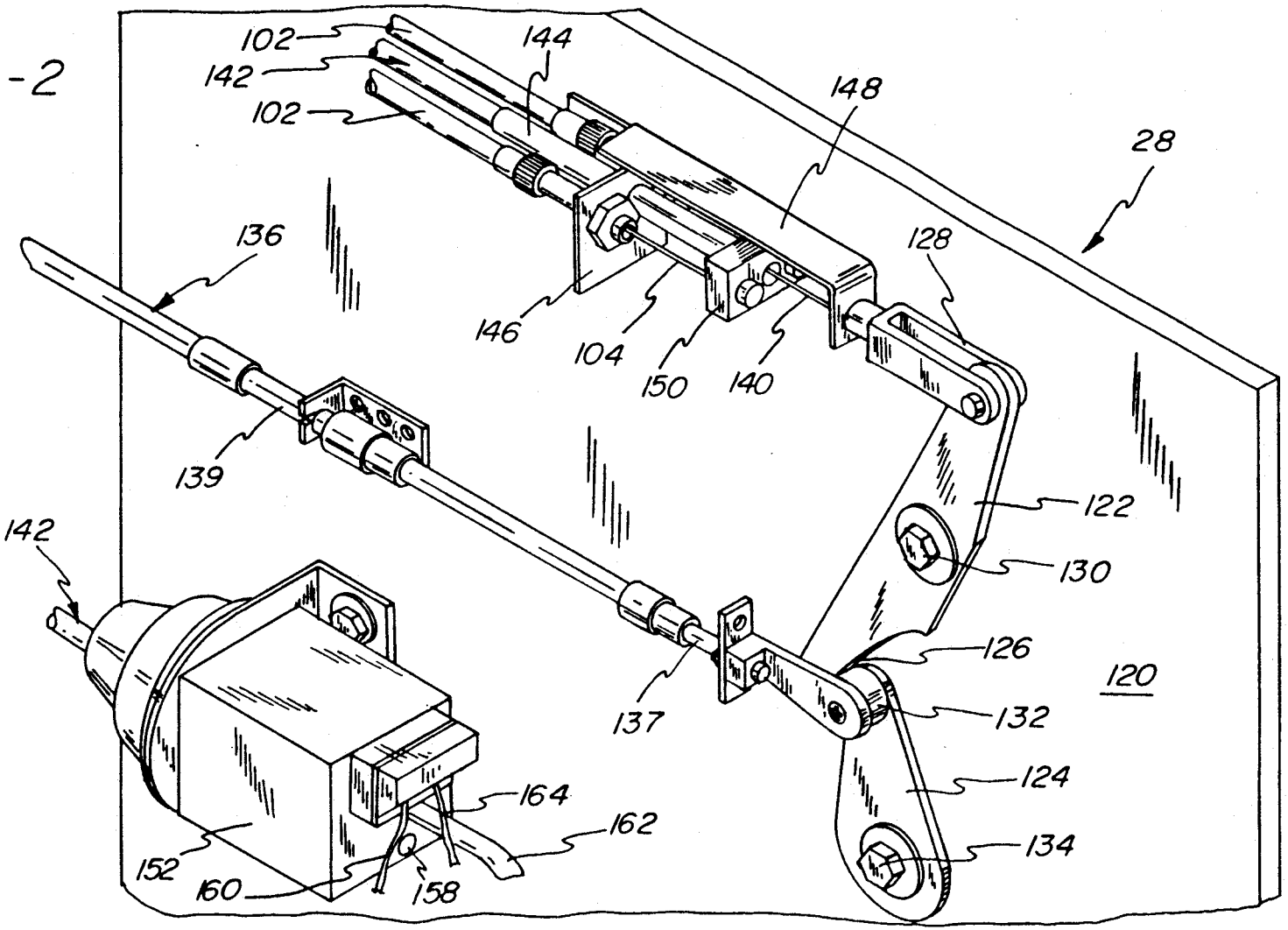
FIG. 2 is an enlarged view of the transfer panel for the mechanical linkage actuator.

The mechanical linkage actuator 28 of FIGS. 1 and 2 includes a transfer panel 120 having a cam lever 122 and a cam actuator 124 mounted thereto. The cam lever 122 includes a cam surface 126 located at one end thereof and a clevis 128 attached to an opposite end. The cam lever 122 is further provided with a pin 130 between its ends whereby the lever 122 is pivotally mounted to the transfer panel 120. A cam roller 132 is attached to one end of the cam actuator 124 and a pivot pin 134 is located at an opposite end for pivotally mounting the cam actuator 124, whereby the cam roller 132 is positioned for engagement with the cam surface 126.

An actuator control cable assembly 136 extends from a connection point 138 where an actuator control cable 137 may be connected to a portion of the throttle control system for the engine such as the throttle control linkage for the carburetor. Alternatively, the actuator control cable 137 could be attached directly to the throttle control 114. A ferrule portion 139 of the other end of the actuator control cable assembly 136 is rigidly mounted to the transfer panel 120 and the actuator control cable 137 is attached to the cam actuator 124 at the location of the cam roller 132 such that movement of the throttle control 114 results in movement of the cam actuator 124 which in turn causes the cam lever 122 to move about its pivot pin 130.

The clevis 128 mounted at the end of the cam lever 122 is connected to a cable portion 140 of a connecting means cable assembly 142 and a ferrule 144 of the connecting means cable assembly 142 is slidably mounted in an anchor bracket 146 attached to the transfer panel 120. The clevis 128 is further provided with a guide 148 which extends toward and engages the anchor bracket 146 in sliding contact to maintain the alignment between the clevis 128 and the ferrule 144 as they move relative to the anchor bracket 146.

The cable covers 102 of the control cable assemblies 100 are immovably attached to the anchor bracket 146, and the control cables 104 are connected to an equalizer bar 150 which is rigidly mounted across the end of the ferrule 144. Thus, when the connecting means cable 140 is actuated, the ferrule 144 and the clevis 128 are drawn toward one another such that the equalizer bar 150 is held stationary relative to the clevis 128 whereby movement of the cam lever 122 results in movement of the control cables 104 to vary the nozzle outlet area.

The connecting means cable assembly 142 is connected to a connecting means actuator 152 which acts to draw the cable 140 toward it in order, to activate the clevis 128 and equalizer bar 150 for movement of the control cables 104. As can be seen in FIG. 2A, the connecting means actuator 152 includes a vent valve 154 and a charge valve 156. The vent valve 154 is normally in an open position which permits the interior of the connecting means actuator 152 to be in fluid communication with the exterior through an outlet passage 158. An electrical line 160 from the ignition system for the engine energizes the vent valve 154 to close the passage 158 when the ignition is on.

The charge valve 156 is normally in a closed position and includes an inlet passage 162 and an electrical line 164 connected to a neutral safety switch associated with a control lever for controlling the transfer of power from the engine to the screw of the boat, such as a clutch lever or a reverse gear lever, such that the line 164 will be energized when the screw is engaged to propel the boat. The inlet passage 162 is connected to the intake manifold of the engine whereby a vacuum charge is provided, in the case of a gasoline engine being used, for activating the connecting means actuator 152.

Thus, the connecting means actuator 152 will be activated when the ignition is turned on to activate the vent valve 154 and close passage 158, and the clutch is engaged to open charge valve 156 such that a vacuum charge is applied to the connecting means actuator 152. Upon actuating the connecting means actuator 152, the connecting means cable 140 is drawn into the connecting means actuator 152 such that the equalizer bar 150 is drawn into contact with the clevis 128 and the control cables 104 will move in response to movements of the cam lever 122.

The above valve arrangement for the connecting means actuator 152 permits the nozzle 24 to remain in a fully open position during engine shutdown such that the flexible orifice means 70 may remain in a relaxed condition when it is not in use and thereby extend its useful life. In addition, by permitting the nozzle to remain in a fully open position until the clutch is engaged, provision is made for permitting the engine to warm up with a minimum of back pressure as well permitting the throttle to be "pumped" or moved back and forth without increasing the back pressure during engine start-up.

It should be noted that once the connecting means actuator 152 is activated, it will remain in an activated condition as long as the ignition line 160 remains energized even if the charge valve 156 is closed as a result of the clutch being disengaged and the line 164 being de-energized. This is because any charge supplied to the connecting means actuator 152 will remain in the connecting means actuator 152 until it is released through the outlet passage 158, such as will occur upon the engine being turned off.

Further, the above system for actuating the clevis 128 may be used with engines in which no source of vacuum is available, such as is the case when a diesel engine is used. In this case, a connecting means actuator 152 may be provided which operates in response to a pressurized charge wherein the pressurized charge is provided from the pressurized air supplied to the intake manifold of the engine.

The cam surface 126 on the cam lever 122 is designed such that the movement of the nozzle orifice 70 will be non-linear relative to the movement of the throttle control 114. Thus, when the connecting means actuator 152 is activated to draw the equalizer bar 150 into engagement with the clevis, movement of the throttle control 114 through the first two-thirds of its travel will result in the nozzle orifice 70 undergoing only approximately one-quarter of its total movement toward the open position, and movement of the throttle control 114 through the final third of its travel will result in the nozzle orifice 70 moving through the final three-quarters of its travel to full open position.

The electromechanical drive actuator means 28 of FIG. 3 includes a transfer panel 166 having a stepping motor 168 which has an output shaft 170 and an input line 172. The output shaft 170 of the stepping motor 168 is threaded to engage a threaded aperture in a plate 174 which is connected to the nozzle control cables 104. Thus, rotation of the stepping motor shaft 170 results in movement of the plate 174 along the motor shaft 170 and consequently in controlled movement of the control cables 104. The direction and extent of rotation of the motor output shaft 170 is controlled by a bi-directional motor control 176 which is connected to the motor 168 through the input line 172 and which receives control signals from a microprocessor 178. The microprocessor 178 in turn receives signals from a speed sensor 180 and a pressure sensor 182 located on the engine 16 and within the exhaust system 10, respectively.

Figure 8:
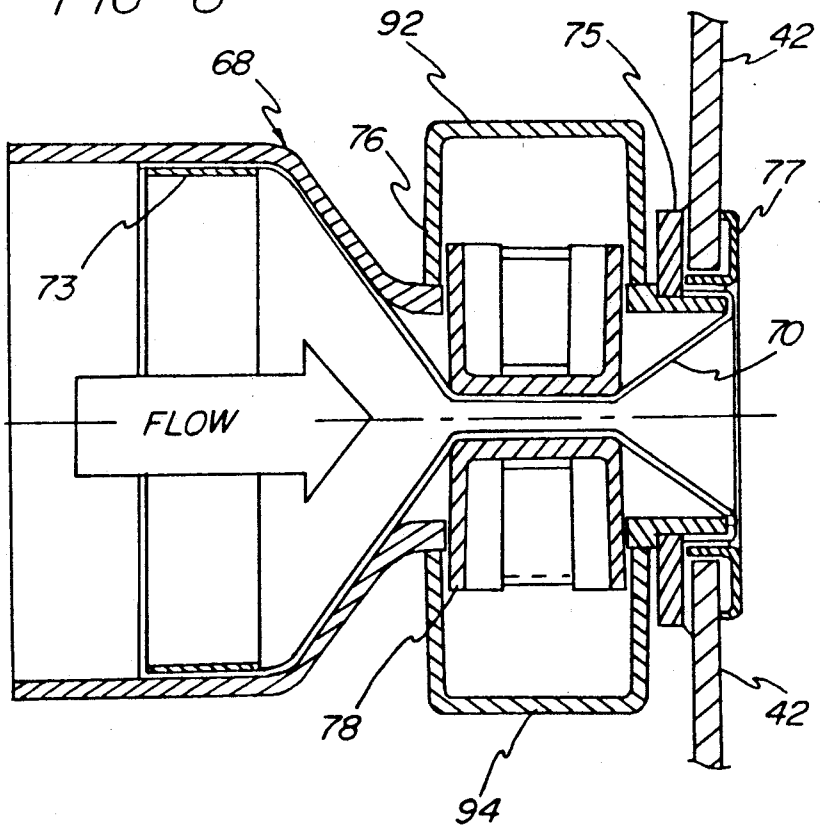
FIG. 8 is an elevational cut-away view of the nozzle in the fully closed position.
Figure 7:
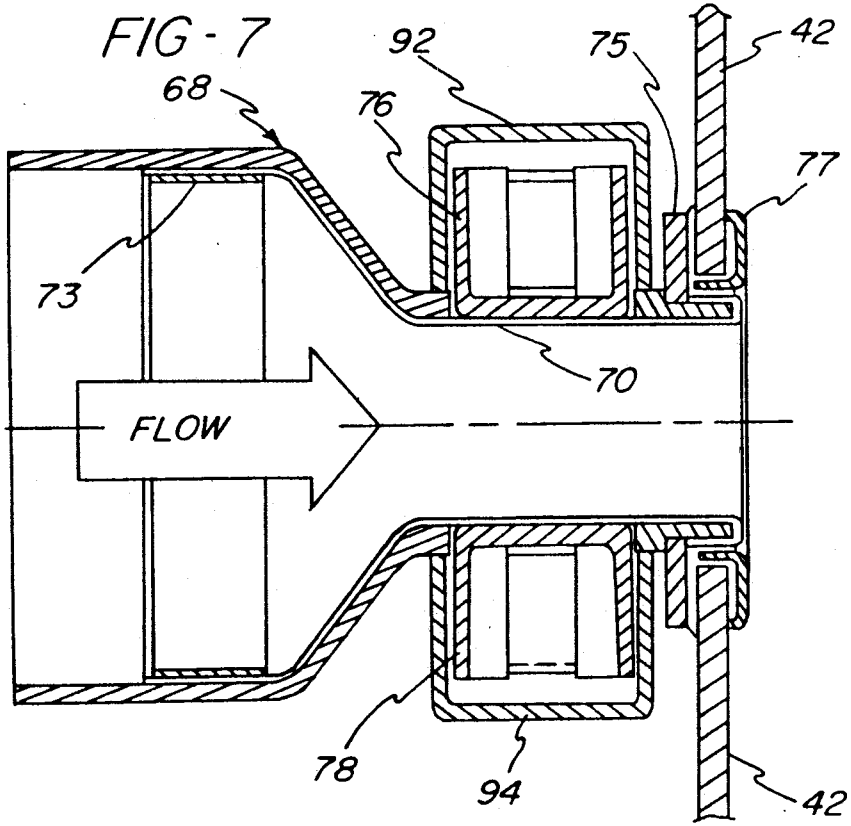
FIG. 7 is an elevational cut-away view of the nozzle in the fully open position.

Thus, the nozzle outlet area may be controlled with direct reference to the engine speed and the exhaust system pressure, such that the nozzle area may be increased at high engine speeds or when excessive pressure is sensed, or the nozzle area may be decreased as the engine speed decreases or the exhaust system pressure is decreased. This is illustrated in FIGS. 7 and 8, in which FIG. 7 shows the position of the nozzle in the fully open position and FIG. 8 shows the position of the nozzle in the closed position. Further, the microprocessor 178 may be programmed to control the movement of the control cables 104 such that the nozzle orifice 70 closes in a non-linear relationship to the engine speed in a manner similar to that described for the embodiment shown in FIG. 1.

As an additional benefit of using a nozzle 24 having a variable outlet area, the area through which the exhaust noises pass is kept to a minimum for any given engine speed. Thus, the variable nozzle 24 also acts as a means of reducing exhaust noise passing out through the exhaust system 10.

An alternative embodiment of the exhaust assembly is shown in FIGS. 9–13 and is designated generally as 20'.

Figure 9:
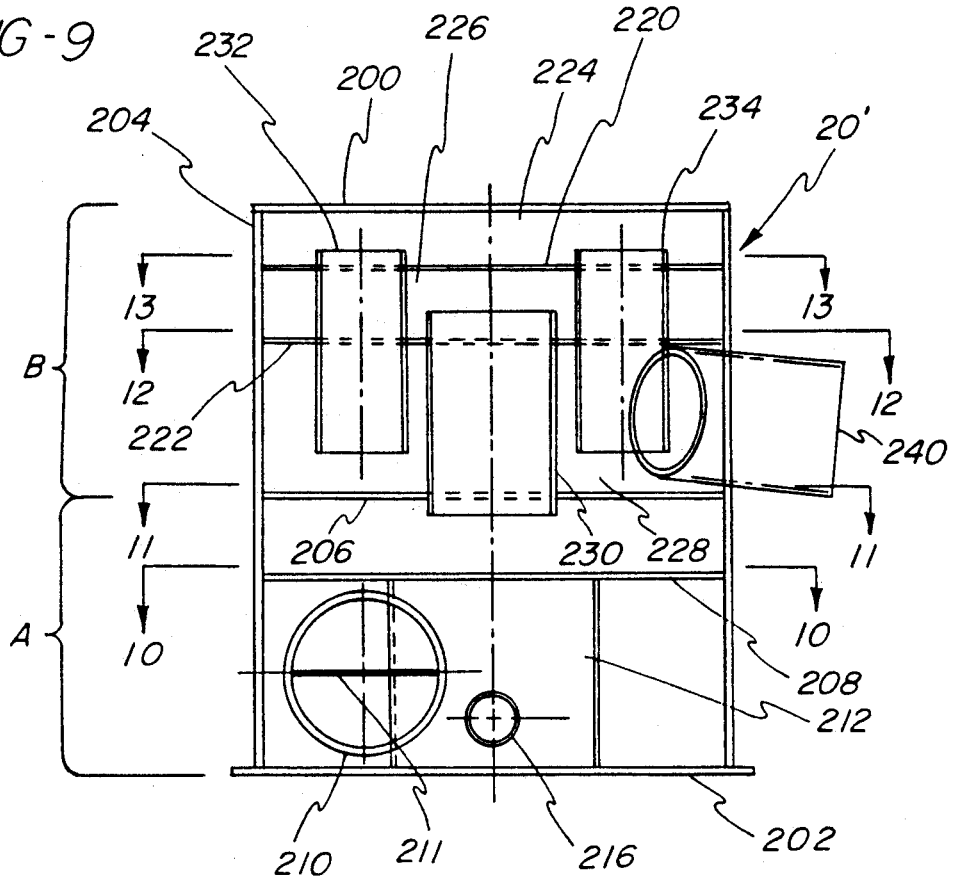
FIG. 9 is a cut-away elevational view of an alterative embodiment of the exhaust assembly.

Referring to FIG. 9, the exhaust assembly 20' is formed having a top wall 200 and a bottom wall 202 with a sidewall 204 extending between the top and bottom walls 200,202 to enclose the working elements of the exhaust assembly 20'.

The exhaust assembly 20' is divided into a lower first portion A and an upper second portion B wherein the first portion A acts as a water separation section and the second portion B acts as an acoustical section for attenuating exhaust noises. The first and second portions A, B are separated from each other by an intermediate wall 206.

A first portion wall 208 is located between the intermediate wall 206 and the bottom wall 202 and an inlet 210 is provided below the first portion wall 208 for receiving a gas/water mixture into the exhaust assembly. It should be noted that the inlet 210 is provided with a divider or baffle plate 211 which operates in the same manner as baffle 30 of the previous embodiment in that it acts provide an initial separation of the water from the gas as it enters the water separation portion A of assembly 20'.

Figure 10:
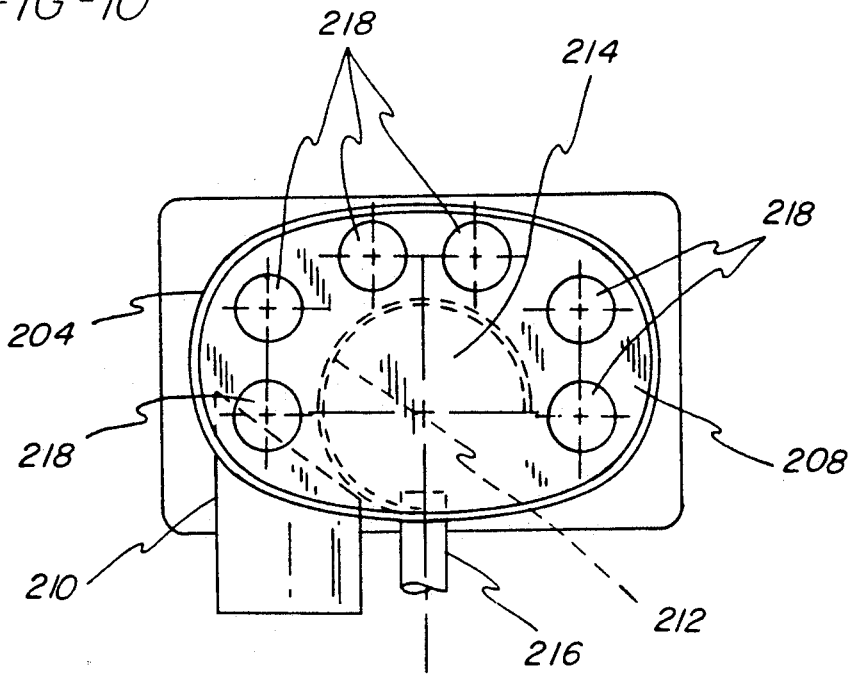
FIG. 10 is a view of the exhaust assembly of FIG. 9 taken along line 10—10.

As can be seen in FIG. 10, the side wall 204 has a generally oval cross section and a curved baffle member 212 is provided extending between the bottom and intermediate walls 202,208 to direct the gas/water mixture around the outer periphery of first portion A of the exhaust assembly 20'. As the gas/water mixture enters the exhaust assembly 20', it follows a path between the baffle 212 and the sidewall 204 until it enters a concavely shaped water trap area 214 formed by the baffle 212. A water exit 216 is located adjacent to the bottom wall 202 and near the concave area 214 for discharging water from the exhaust assembly 20'. Thus, the removal of the water form the exhaust assembly 20' is facilitated by causing the water to continue moving in a curved path within the first portion A until it reaches the water exit 216 where centrifugal force facilitates its flow out of the assembly 20'.

As may be seen in FIG. 10, the first portion wall 208 is provided with means defining a series of apertures 218 which allow exhaust gases to pass upwardly to the intermediate wall 206. Thus, as a gas/water mixture enters the first portion A through the inlet 210, the water is directed toward the water exit 214 as the exhaust gases are allowed to flow upwardly away from the water and into the space between the intermediate wall 206 and the first portion wall 208.

As may be seen in FIG. 9, the second portion B includes an upper wall 220 and a lower wall 222 such that an upper chamber 224 is defined between the top and upper walls 200,220, an intermediate chamber 226 is defined between the upper and lower walls 220,222 and a lower chamber 228 is defined between the lower and intermediate walls 222,206. In addition, a primary conduit 230 is provided extending between the intermediate and lower walls 206,222 to provide a fluid passage between the first portion A and the intermediate chamber 226 of the second portion B, and secondary conduits 232,234 are provided extending between the upper and lower walls 220,222 to provide fluid communication between the upper and lower chambers 224,228.

Figure 13:
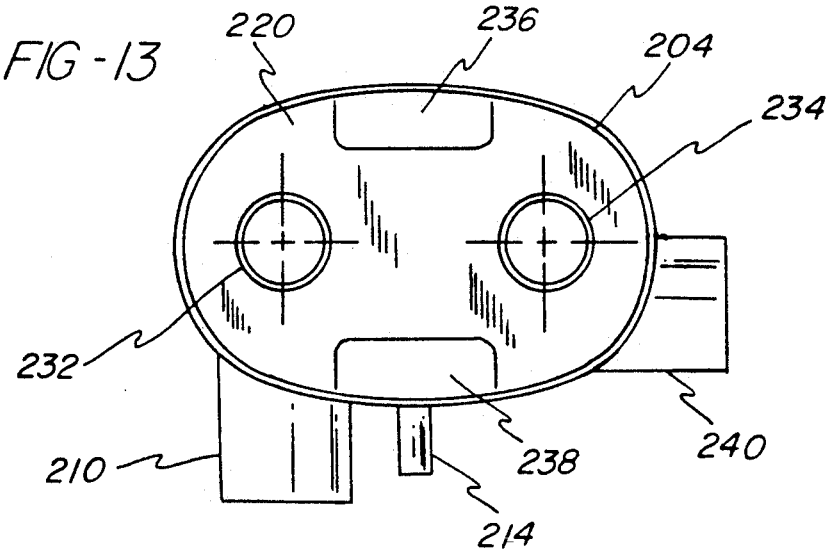
FIG. 13 is a view of the exhaust assembly of FIG. 9 taken along line 13—13.

Referring to FIG. 13, which shows the upper plate 220, means defining apertures 236,238 are provided in the upper plate such that exhaust gases may flow from the intermediate chamber 226 upwardly to the upper chamber 224. Thus, in the operation of the exhaust assembly 20' exhaust gases pass from the first portion A through the conduit 230 to the intermediate chamber 226. The gases then flow through the apertures 236,238 into the upper chamber 224 and then are conducted downwardly through the conduits 232,234 to the lower chamber 228 where they are conveyed away from the exhaust assembly by means of an exhaust exit 240 located in fluid communication with the lower chamber 228.

Figure 11:
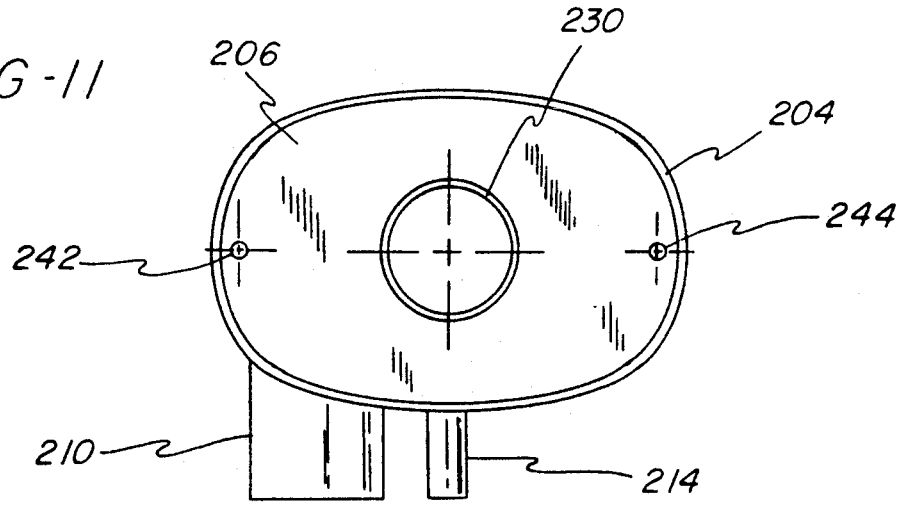
FIG. 11 is a view of the exhaust assembly of FIG. 9 taken along line 11—11.
Figure 12:
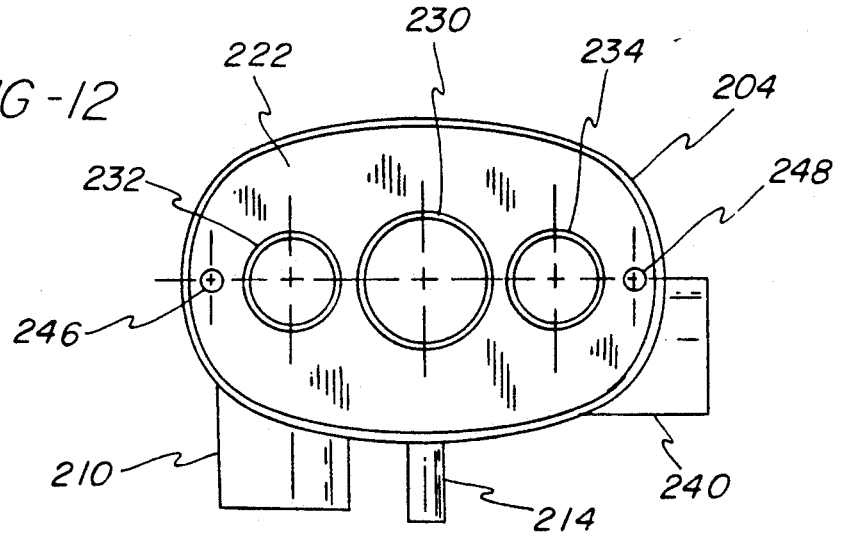
FIG. 12 is a view of the exhaust assembly of FIG. 9 taken along line 12—12.

Referring to FIGS. 11 and 12, it can be seen that the intermediate wall 206 is provided with a pair of apertures 242,244 and that the lower wall 222 is provided with a similar pair of apertures 246,248. The apertures 242,244, 246,248, provide means whereby water in the chambers of the second portion B may drain downwardly into the first portion A and then exit through the water exit 214.

Figure 14:
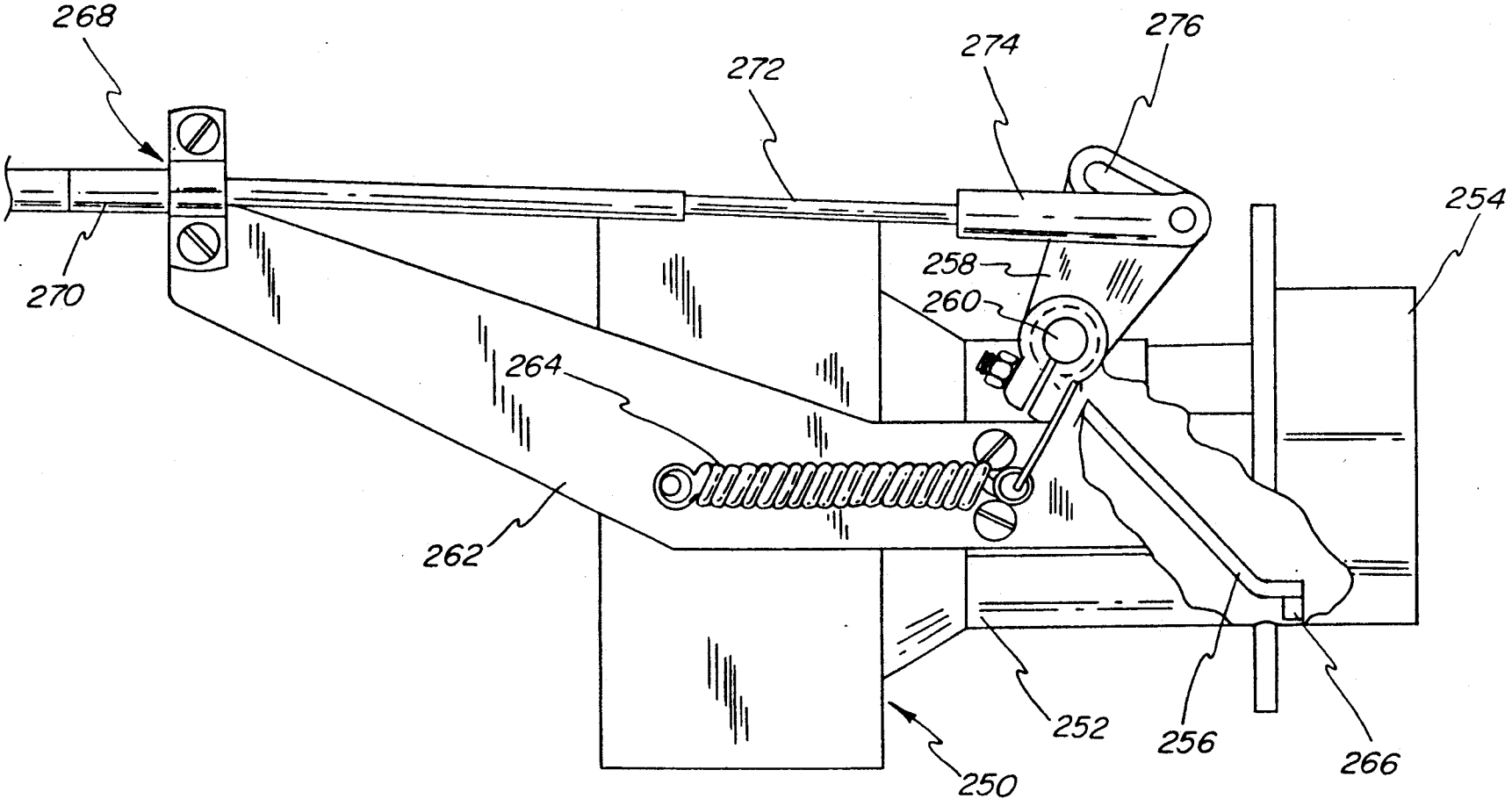
FIG. 14 is a partially cut-away view of an alternative nozzle assembly having a pivoting gate.
Figure 15:
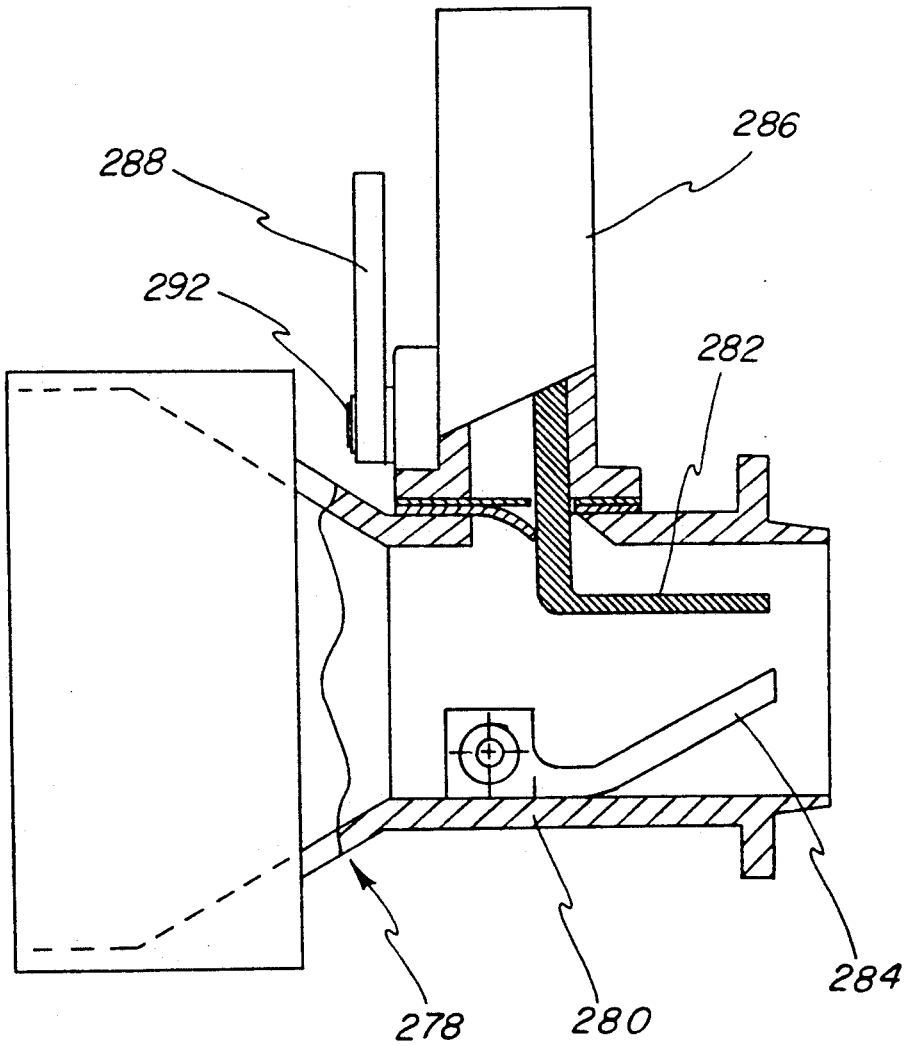
FIG. 15 is an elevational partial sectional view of a second alternative embodiment of the nozzle of the present invention having a sliding gate.

An alternative embodiment of the nozzle is shown in FIG. 14 and is designated generally as 250. The nozzle 250 includes a nozzle body 252 which has a generally rectangular cross section at an exit end 254 of the nozzle similar to the previous embodiment of the nozzle.

The nozzle 250 includes control means comprising a substantially planar gate 256 mounted for pivotal movement substantially perpendicular to a longitudinal axis defined by a flow passage through the nozzle body 252, and a lever 258 rigidly attached to the gate 256. A pivot shaft 260 is provided extending across the width of the nozzle body 252 to form a pivot point for the gate 256.

A bracket member 262 is attached to the exterior of the nozzle body 252 and forms a support for a biasing spring 264 which biases the lever 258 in a clockwise direction, as seen in FIG. 14, to position the gate 256 in a normally closed position. The gate 256 is further provided with cushioning means 266 which may be in the form of resilient pads positioned on opposing edges of the gate 256. The cushioning means 266 prevent direct contact between the gate 256 and the nozzle body 252 to thereby limit noise which may result from the gate 256 vibrating within the nozzle 250.

As in the previous embodiment of the nozzle, a cable assembly 268 is provided including a cable cover 270 and a cable 272. One end of the cable includes a clevis member 274 which is engaged within a slot 276 formed in the lever 258. The opposing end of the cable 272 may be attached directly to a cable attachment point on the carburetor of he engine such that the cable moves in direct relationship to the throttle linkage.

It should be noted that as a result of providing a slot 276 at the attachment point for the clevis member 274, the throttle may be advanced to increase the engine speed a certain predetermined amount before the gate 256 is moved to open up the flow passage for the nozzle. In the preferred embodiment, the engine speed is increased to approximately 2,000 rpm (for a gasoline engine) before the clevis member 274 engages the left end of the slot 276 to begin movement of the gate member 256. Thus, the cross sectional area of the flow passage may be continuously varied as the control means 256,258 is actuated for movement by the cable assembly 268 and clevis member 274.

Another configuration for the nozzle is shown in FIGS. 15-18 in which the nozzle is indicated generally as 278. As may be seen in FIG. 15, the nozzle 278 includes a nozzle body 280 defining a flow passage along the longitudinal axis of the nozzle and a substantially planar gate 282 mounted for vertical sliding movement substantially perpendicular to the longitudinal axis of the nozzle 278 and parallel to the plane of the gate 282 to vary the cross section of the flow passage. As in the previous embodiment shown in FIG. 14, resilient cushioning means 284 are provided to prevent rattle which may result from the gate 282 contacting the nozzle body 280 in the closed position of the gate. The cushioning means 284 may be in the form of a pair of strips located on either side of the nozzle body.

The gate 282 extends upwardly into a control body 286 mounted to the top of the nozzle body 280 and a lever 288 is provided at a rear portion of the control body 286 for effecting vertical movement of the gate 282 through a control mechanism which is described further below.

Figure 16:
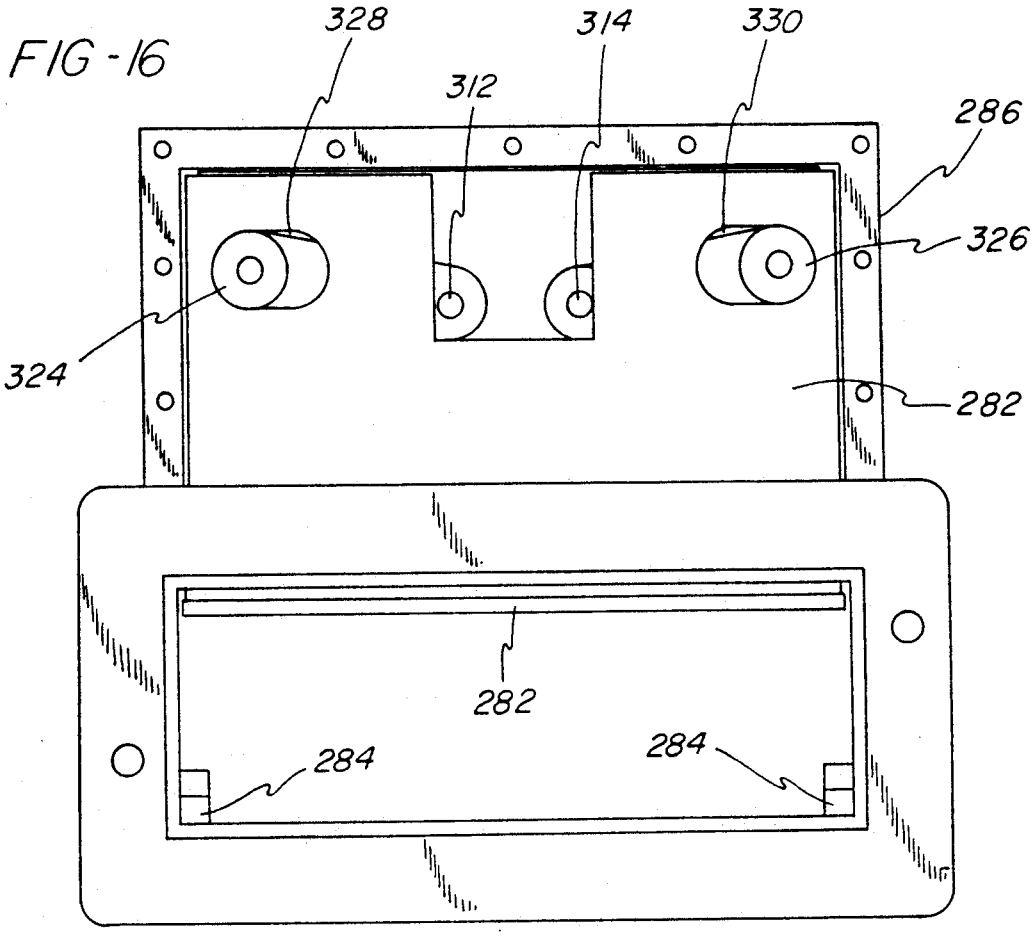
FIG. 16 is a front elevational view of the nozzle of FIG. 15 with the front cover of the control body for the nozzle removed.
Figure 17:
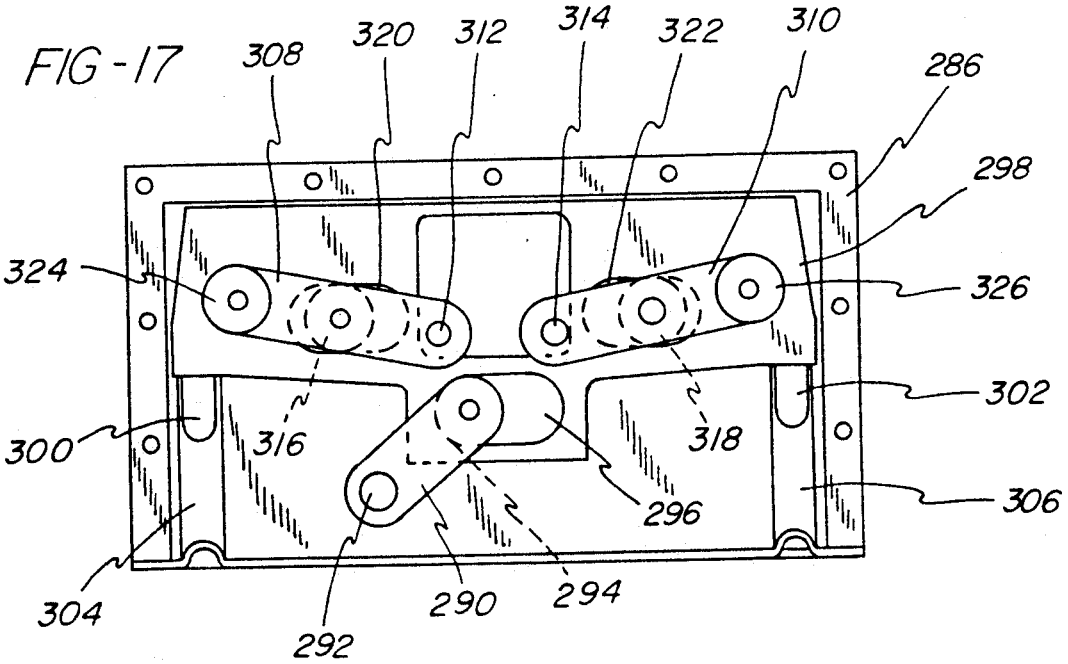
FIG. 17 is a view of the control body of the nozzle of FIG. 15 with the front cover and sliding gate member removed.

Referring to FIGS. 16 and 17, the control mechanism for moving the gate 282 includes an actuating arm 290 rigidly at ached to the lever 288 through a pivot shaft 292. An end of the actuator arm 290 opposite from the shaft 292 carries a roller 294 which is positioned within a slot 296 formed in an auxiliary slide 298. The auxiliary slide 298 is vertically movable within the control body 286 and includes a pair of guide members 300,302 positioned to slide within guide slots 304,306 formed in the back wall of the control body 286. Thus, as the lever 288 and actuating arm 290 are pivoted about the pivot point formed by the shaft 292, the auxiliary slide 298 is caused to move up and down within the control body.

The control mechanism is further provided with a pair of idler arms 308,310 which are mounted for pivotal movement on pins 312,314. The pins 312,314 in turn are attached to the front and rear walls of the control body 286.

Each of the idler arms 308,310 carries an idler roller 316,318, respectively, at positions midway between the ends of the idler arms 308,310. The idler rollers 316,318 are engaged within slots 320,322 formed in the auxiliary slide 298 such that vertical movement of the auxiliary slide 298 results in pivotal movement of the idler arms 308,310 about the pins 312,314.

The end of the idler arms 308,310 opposite from the pivot pins 312,314 are provided with rollers 324,326 which are engaged within slots 328,330 formed in the gate 282. It should therefore be apparent that as the actuating arm 290 is pivoted to cause vertical movement of the auxiliary slide 298, the idler arms 308,310 are caused to pivot and move the rollers 324,326 in a vertical direction whereby the gate 282 is caused to move vertically up and down within the flow passage of the nozzle.

Figure 18:
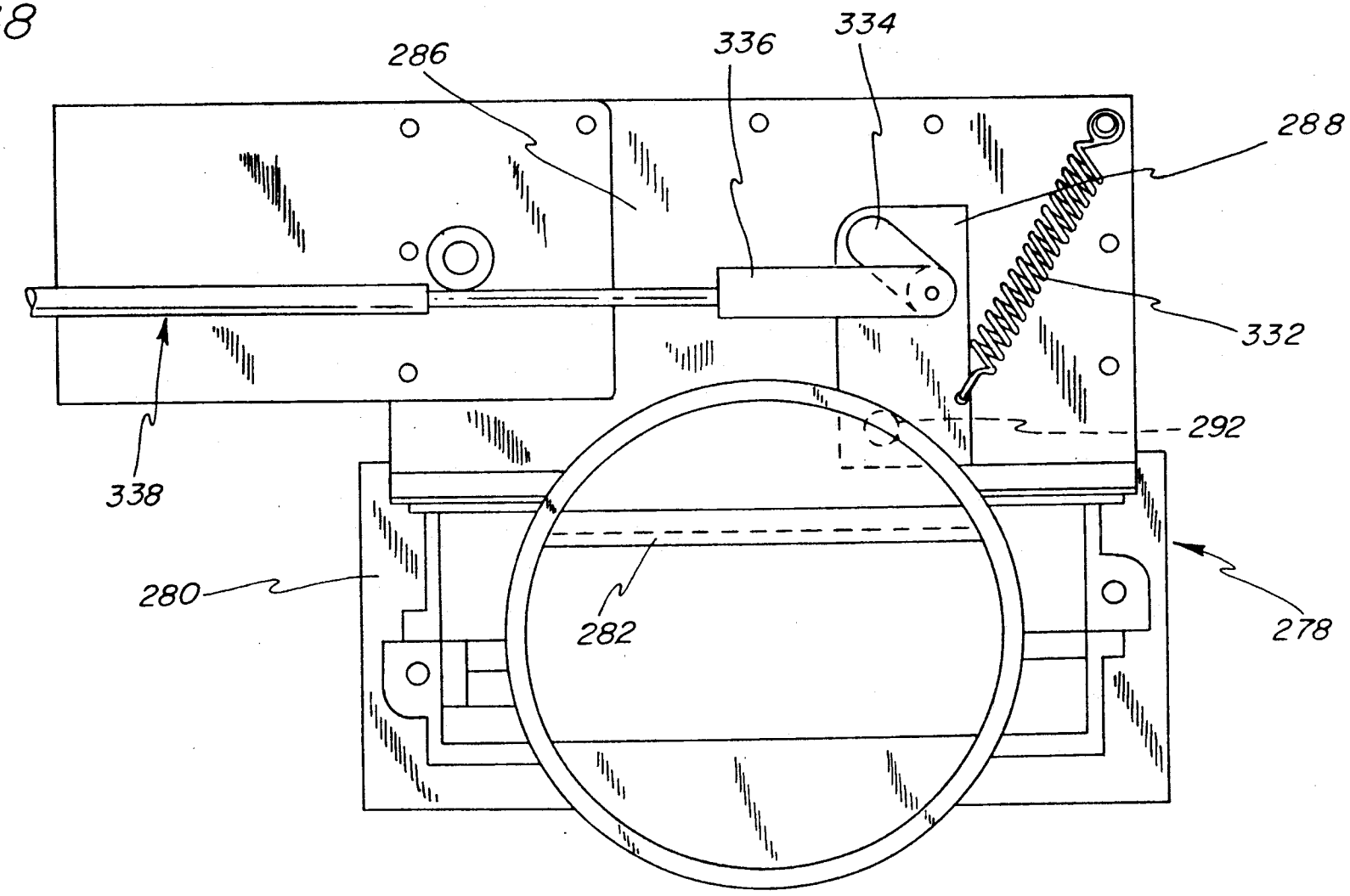
FIG. 18 is a rear elevational view of the nozzle of FIG. 15.

Referring to FIG. 18, it can be seen that the mechanism for actuating the lever is similar to that shown in the embodiment of FIG. 14. A spring 332 is provided for biasing the lever 288 to move the gate 282 into a closed position. The lever 288 is also provided with a slot 334 such that an actuating mechanism consisting of a clevis member 336 and cable assembly 338 may move a predetermined amount before causing actuation of the lever 288.

It should be noted that the lever 288 moves in a clockwise direction, as seen in FIGS. 18, to open the gate 282 of the nozzle and that the nozzle is shown in an open position in this view. Thus, the cable assembly 338 must push the clevis member 336 forwardly to open the nozzle.

In addition, when the spring 332 pulls the lever 288 in a counterclockwise direction to close the gate 282, the slot 334 will move to a horizontal position substantially aligned with the cable 338 and clevis member 336. Thus, during the initial movement of the clevis member 336 from one end of the slot 334 to the other end, the clevis member 336 will pass freely between the sides of the slot 334 without causing the lever 288 to pivot.

Referring to FIGS. 19–24, a third embodiment of the exhaust assembly is shown and is designated generally as 400. As may be seen in FIG. 19, the exhaust assembly 400 is of a horizontal configuration and is divided into two sections composing a first water separation portion A' and a second sound attenuation portion B', wherein the first and second portions A', B' are located in side-by-side relationship to each other.

Figure 20:
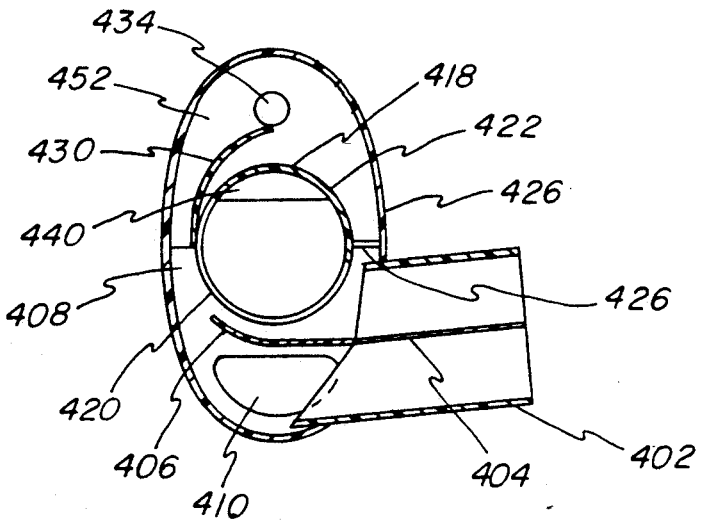
FIG. 20 is an elevational view taken along line 20—20 in FIG. 19

Referring to FIG. 20, an inlet tube 402 is connected to the first portion A' and includes a divider or baffle plate 404 for providing an initial separation of exhaust gas from water as it approaches the assembly 400. A water diverter plate 406 forms a continuation of the baffle plate 404 to insure that the gas remains separated from the water as it enters the exhaust assembly 400. A lower baffle plate 408 is positioned within the lower half of the exhaust assembly 400 and includes an aperture 410 for allowing water to pass from an entry chamber 412 to a discharge chamber 414 where water may pass out of the exhaust assembly 400 through a first water discharge tube 416.

A cylindrical air tube 418 extends between the entry chamber 412 and discharge chamber 414 for conveying exhaust gases between the two chambers and includes an inlet opening 420 (see FIG. 19) for receiving gases as they come from the inlet tube 402. In addition, the air tube 418 includes a curved extension of the tube 422 which extends substantially to the front end wall 424 of the exhaust assembly 400, and a short shelf 426 bridges the gap between the exhaust assembly sidewall 428 and a lower edge of the extension 422. The shelf 426 extends from the wall 424 to the lower baffle plate 408 such that the extension 422 and shelf 426 provide a protective cover to prevent water from falling down onto the water diverter plate 406.

An air tube shield 430 further directs the water within the entry chamber 412 and extends from the end wall 424 to an upper baffle plate 432. The upper baffle plate 432 extends at an angle away from the lower baffle plate 408, as may be best seen in FIG. 21, and straddles the upper half of the air tube 418. Further, the upper baffle 432 includes an aperture 434 for permitting the passage of gases between the entry and discharge chambers 412,414.

In operation, a gas/water mixture enters the exhaust assembly 400 through the inlet tube 402 with the gas substantially separated from the water by the plate 404 and divider 406. As water enters the entry chamber 412 along the lower portion of the inlet tube 402, it passes through the aperture 410 into the discharge chamber 414 where it may be directed away from the exhaust assembly 400 by the outlet tube 416. Water entering the entry chamber 412 through the upper portion of the inlet tube 402 will be carried by momentum past the air tube inlet 420 and will be diverted upwardly by the end of the diverter plate 406 to follow a curved path defined between the air tube shield 430 and the curved wall 428 of the exhaust assembly 400. As the water reaches the edge of the air tube shield 430, it will fall onto the extension 422 and shelf 426 and thereafter flow through a gap 436 defined between the sidewall 428, the air tube 418, the upper baffle 432 and an end of the shelf 426. This water will then be retained in the water discharge chamber 414 by the lower baffle plate 408 until it is discharged through the exit tube 416.

Exhaust gases entering the entry chamber 412 will be conveyed by the air tube 418 directly to the discharge chamber 414 for passage into the second portion B' of the exhaust assembly 400. It should be noted that the air tube 418 includes a lower extension portion 436 extending within the discharge chamber 414 which allows the exhaust gases to pass upwardly while acting as a baffle to prevent water in the lower portion of the chamber 414 from mixing with the gases.

The second portion B' of the exhaust assembly includes a first exhaust tube 438 substantially located at an elevation higher than the air tube 418. A slight overlap exists between upper portion of the air tube 418 and the lower portion of the first exhaust tube 438 and a baffle plate 440 is attached to the upper portion of the air tube 418 in this area of overlap. The baffle plate 440 acts to prevent any water within !he air tube 418 from being conveyed directly from the air tube 418 to the first exhaust tube 438.

Figure 19:
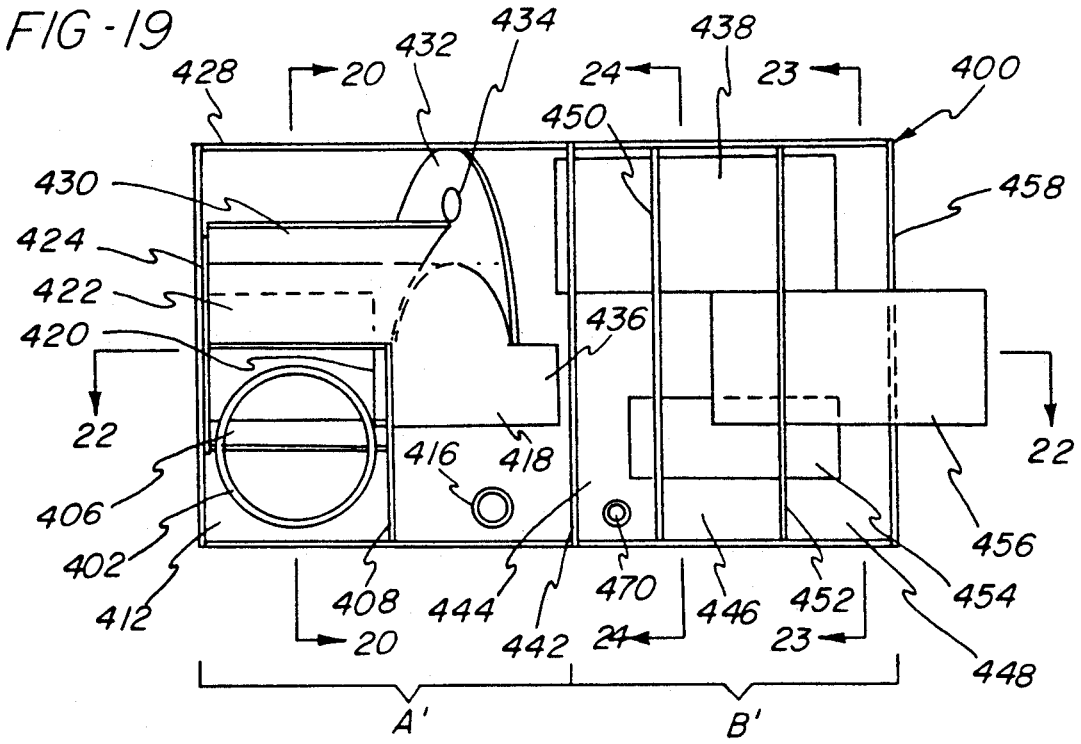
FIG. 19 is a cut-away elevational view of a third embodiment of the exhaust assembly in which a sidewall portion thereof has been removed to show interior components.
Figure 21:
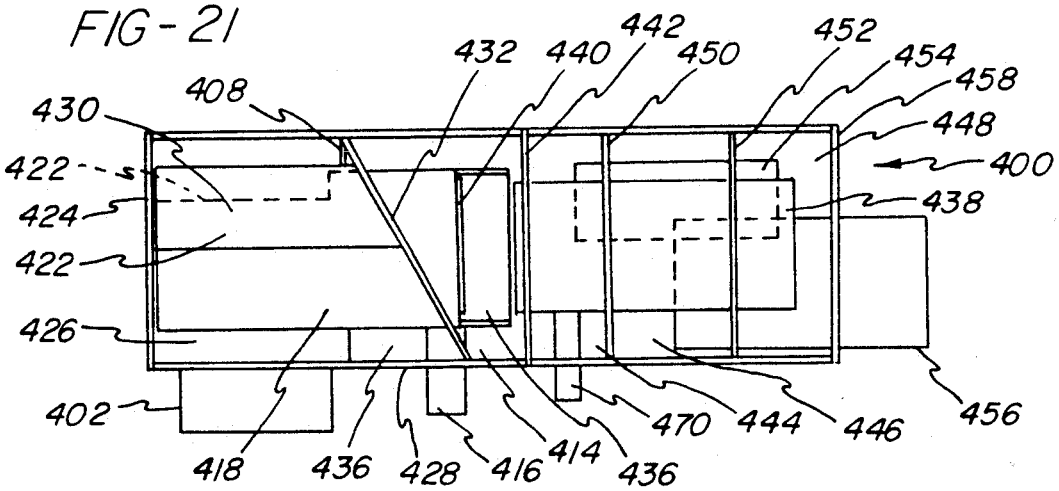
FIG. 21 is a cut-away plan view of the exhaust assembly of FIG. 19 in which a sidewall portion thereof has been removed to show interior components.
Figure 22:
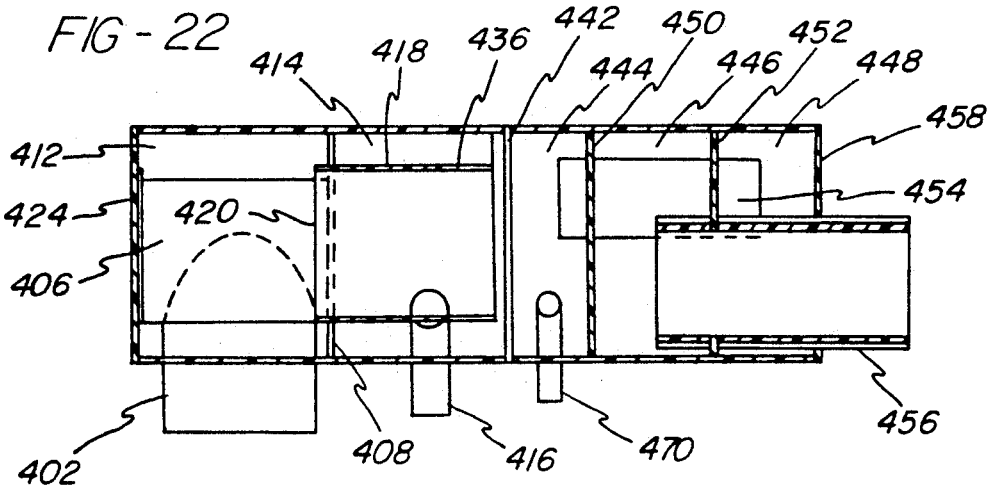
FIG. 22 is a sectional plan view taken along line 22—22 in FIG. 19.

As may be seen in FIGS. 19 and 21, the second portion B' is separated from the first portion A' by means of an intermediate wall 442 and the second portion B' is divided into first, second and third chambers 444,446,448 by means of first and second baffle plates 450,452. The first exhaust tube 438 extends from the first portion A' to the third exhaust chamber 448 and a second exhaust tube 454 extends from the third chamber 448 to the first chamber 444. Finally, a third exhaust tube 456 extends from the second chamber 446 through an end wall 458 of the exhaust assembly 400 to provide an exit for exhaust gases from the exhaust assembly 400.

Figure 23:
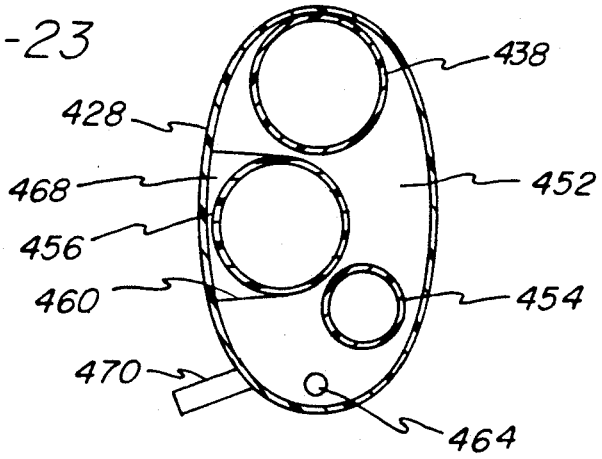
FIG. 23 is a sectional elevational view taken along line 23—23 :n FIG. 19.

As may be seen in FIG. 23, the second baffle plate 452 is provided with a slot 460 through which the third exhaust tube 456 passes, and a gap 462 remains between the tube 456, the slot 460 and the side wall 428 to allow passage of exhaust gases from the third chamber 448 to the second chamber 446. In addition, a small aperture 464 is provided near the base of the plate 452 for permitting passage of water between the third and second chambers 448,446.

Figure 24:
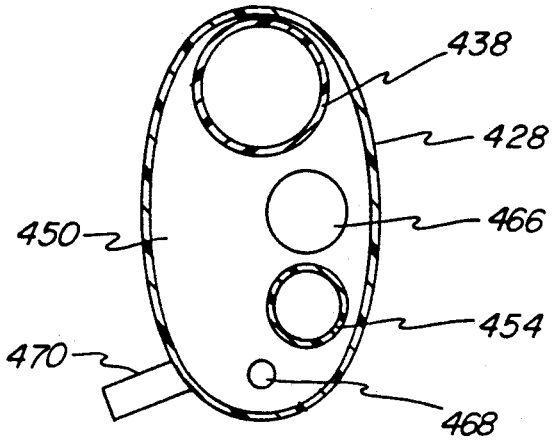
FIG. 24 is a sectional elevational view taken along line 24—24 in FIG. 19.

As may be seen in FIG. 24, the first plate 450 includes an aperture 466 for permitting exhaust gases to pass from the first chamber 444 to the second chamber 446. Also, a second aperture 468 is provided in the first plate 450 for allowing water to flow from the second chamber 446 to the first chamber 444 where it may be discharged from the exhaust assembly 400 by means of second water exit tube 470.

In operation, exhaust gases enter the second portion B' through the first tube 438 and are conveyed into the third chamber 448 where they may either pass through the second tube 454 to be conveyed to the first chamber 444, or they may pass through the gap 462 to enter the second chamber 446. The exhaust gases in the first chamber 444 will then pass through the aperture 466 into the second chamber 446, and the gases in the second chamber 446 will be conveyed out of the exhaust assembly 400 by means of the third exhaust the 456.

As it apparent from the above description, the present marine exhaust system provides an effective and efficient means for projecting exhaust gases to a point outside of the turbulent boundary layer surrounding the hull of a boat in motion. This is accomplished by varying the nozzle outlet area to maintain a pressure within the exhaust system which is equal to or less than the pressure recommended by the engine manufacturer. Thus, a maximum pressure within the system is maintained for projecting the gases a maximum distance from the boat at all engine and boat speeds.

While the forms of apparatus herein described constitute preferred embodiments of the invention, it is to be understood that the invention is not limited to these precise forms of apparatus, and that changes may be made therein without departing from the scope of the invention which is defined in the appended claims.

What is claimed is:

1. An exhaust system for use with a marine engine, said exhaust system comprising:

an exhaust assembly having an inlet for receiving a gas/water mixture, an exhaust gas outlet for expelling exhaust gases, and means separate from said exhaust gas outlet for conveying water from said exhaust assembly;

a nozzle having an inlet and an outlet, a flow passage defined between said inlet and said outlet, said nozzle inlet being connected to said exhaust gas outlet;

control means for varying the cross-sectional area of said flow passage whereby the velocity of exhaust gases exiting said nozzle may be increased; and actuator means for actuating said control means such that said control means defines a desired cross-sectional area within said flow passage.

2. The exhaust system of claim 1, wherein said flow passage is defined by a nozzle body and said control means is movable relative to said nozzle body between positions defining maximum and minimum cross-sections of said flow passage.

3. The exhaust system of claim 2, wherein biasing means are provided for biasing said control means to said position defining said minimum cross-section of said flow passage.

4. The exhaust system of claim 3, wherein said biasing means includes a spring attached to said control means.

5. The exhaust system of claim 1, wherein said control means includes an element extending across said flow passage, said actuator means acting to move said element to restrict the cross-sectional area of said flow passage and thereby increase the velocity of said exhaust gases exiting said nozzle.

6. The exhaust system of claim 1, wherein said flow passage defined a longitudinal axis of said nozzle and said control means includes a substantially planar plate mounted for movement in a direction substantially perpendicular to said longitudinal axis.

7. The exhaust system of claim 6, wherein said plate defines a plane and said plate moves in a direction substantially parallel to said plane to vary the crosssectional area of said flow passage.

8. The exhaust system of claim 6, wherein said plate is mounted for pivotal movement to vary the cross-sectional area of said flow passage.

9. The exhaust system of claim 1, wherein said actuator means includes a control cable assembly having one end thereof attached to said control means.

10. The exhaust system of claim 9, wherein a second end of said control cable assembly is attached to means for controlling the speed of an engine associated with said exhaust system.

11. The exhaust system of claim 1, wherein said control means includes a movable element positioned for movement within said flow passage and a lever mounted for pivotal movement, wherein movement of said lever causes said movable element to vary said cross-section of said flow passage.

12. The exhaust system of claim 11, wherein said lever includes means defining a slot therein and said actuator means is engaged within said slot.

13. The exhaust system of claim 12, wherein said actuator means includes a control cable assembly and engagement means attached to an end of said control cable assembly and received for sliding movement within said slot whereby said control cable assembly may move said engagement means a predetermined distance within said slot and, subsequently, slid engagement means engages an end of said slot to move said lever.

14. An exhaust system for use with a marine engine, said exhaust system comprising:

an exhaust assembly having top and bottom walls and first and second portions defined between said top and bottom walls, said second portion being located above said first portion;

an intermediate wall located between said first and second portions;

said first portion having an inlet for receiving a gas/water mixture and a water exit for discharging water from said exhaust assembly;

aperture means defined in said intermediate wall for allowing passage of exhaust gases from said first to said second portion;

an exhaust gas exit located between said intermediate wall and said top wall for discharging exhaust gas from said exhaust assembly;

a nozzle connected to said exhaust gas exit, said nozzle having a flow passage therethrough and control means for varying the cross-sectional area of said flow passage.

15. The exhaust system of claim 14, wherein said control means includes a movable element positioned for movement within said flow passage and a lever mounted for pivotal movement, wherein movement of said lever causes said movable element to vary said cross-sectional area of said flow passage.

16. The exhaust system of claim 15, wherein said lever includes means defining a slot therein and actuator means are provided engaged within said slot.

17. The exhaust system of claim 16, wherein said actuator means includes a cable assembly and engagement means attached to an end of said cable assembly and received for sliding movement within said slot whereby said cable assembly may move said engagement means a predetermined distance within said slot and, subsequently, said engagement means engages an end of said slot to move said lever.

* * * * *